United States Patent [19]

Ominato

[11] Patent Number: 4,730,950

[45] Date of Patent: Mar. 15, 1988

[54] BINDING DEVICE

[75] Inventor: Kiyoshi Ominato, Tokyo, Japan

[73] Assignee: King Jim Co., Ltd., Tokyo, Japan

[21] Appl. No.: 48,904

[22] Filed: Apr. 24, 1987

[30] Foreign Application Priority Data

Apr. 28, 1986 [JP] Japan ..... 61-96890

[51] Int. Cl.[4] ..... B42F 13/32; B42F 13/34

[52] U.S. Cl. ..... 402/48; 402/45; 402/46

[58] Field of Search ..... 402/46, 45, 48, 50, 402/52, 54

[56] References Cited

U.S. PATENT DOCUMENTS

| | | | |
|---|---|---|---|
| 2,836,182 | 5/1958 | Gramacy | 402/50 |
| 4,168,920 | 9/1979 | Ohminato | 402/48 X |
| 4,693,625 | 9/1987 | Ohminato | 402/48 X |

FOREIGN PATENT DOCUMENTS

| | | | |
|---|---|---|---|
| 2107125 | 8/1978 | Fed. Rep. of Germany | 402/48 |

*Primary Examiner*—Paul A. Bell

*Attorney, Agent, or Firm*—Young & Thompson

[57] ABSTRACT

A binding device is disclosed, which comprises an elongated fixture having at least one pipe fitting in the vicinity of one longitudinal side end thereof and a cover plate having in the vicinity of its longitudinal one end at least one coupling rod adapted to be inserted into said pipe fitting, wherein the fixture is provided with support members along its longitudinal opposite side end at a predetermined distance, each of said support members being provided with a vertically extended slit and an external recess in communication with the slit and the fixture is further provided with elastic arm members at its opposite cross ends, each of said elastic arm members at its one end being secured to the fixture and at its opposite free end being confronted with the recess of the support member, while the cover plate is provided in the vicinity of its longitudinal opposite end with insertion members each comprising a vertical guide piece member and a flexible piece member with an outward protrusion and arranged symmetrically to cope with the support members of the fixture.

10 Claims, 13 Drawing Figures

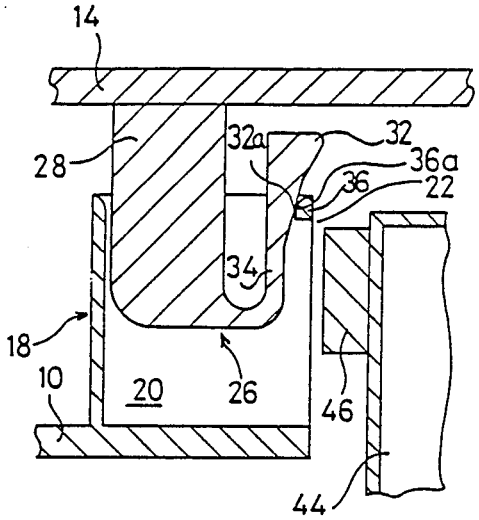
FIG.3(a)
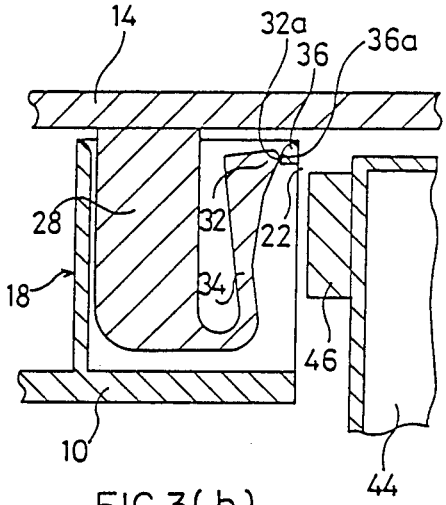
FIG.3(b)
FIG.3(c)
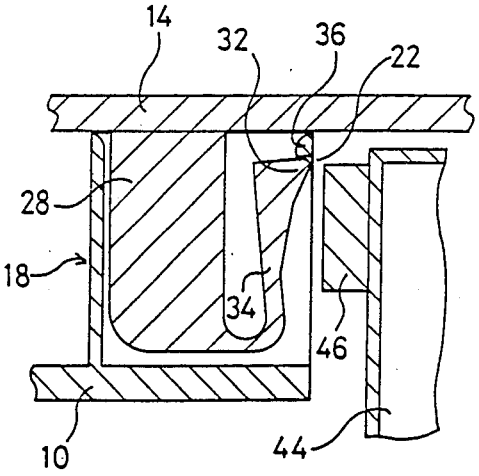
FIG.3(d)
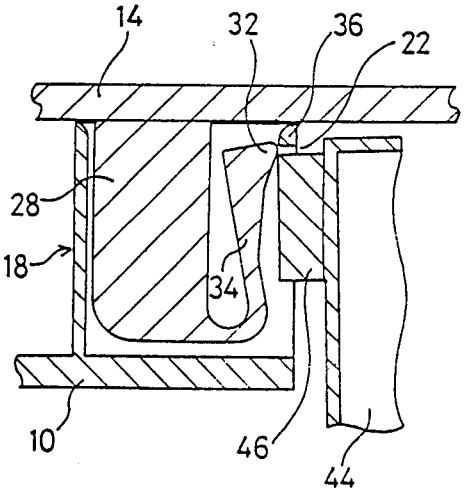

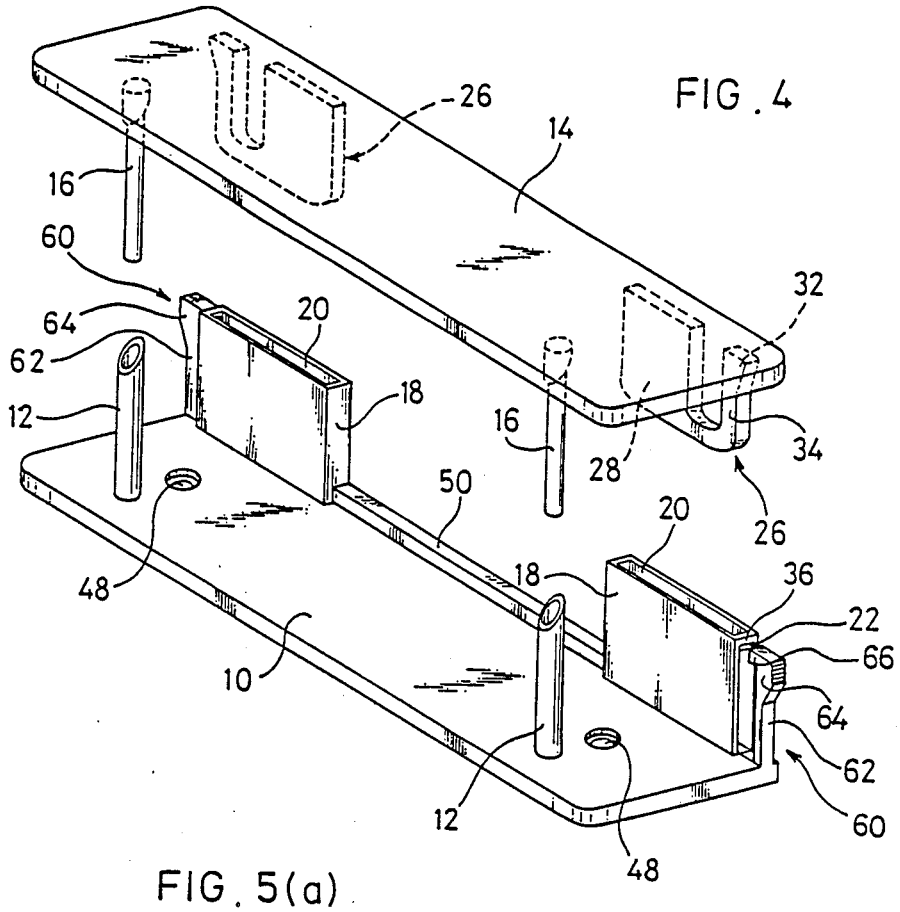
FIG. 4
FIG. 5(a)
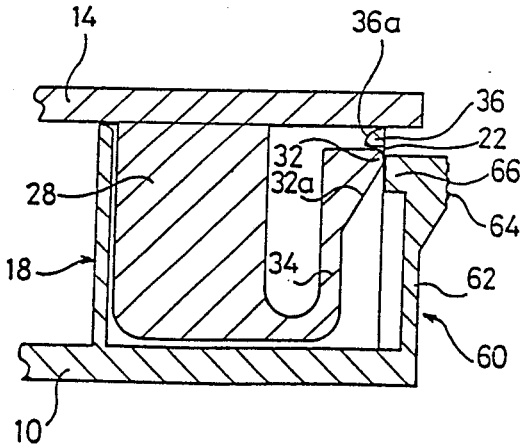
FIG. 5(b)
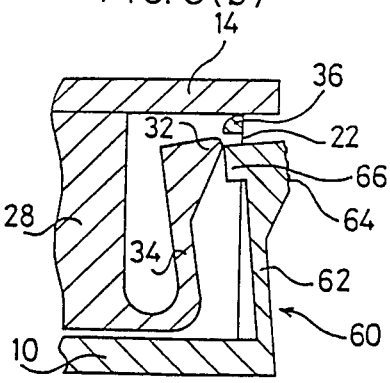

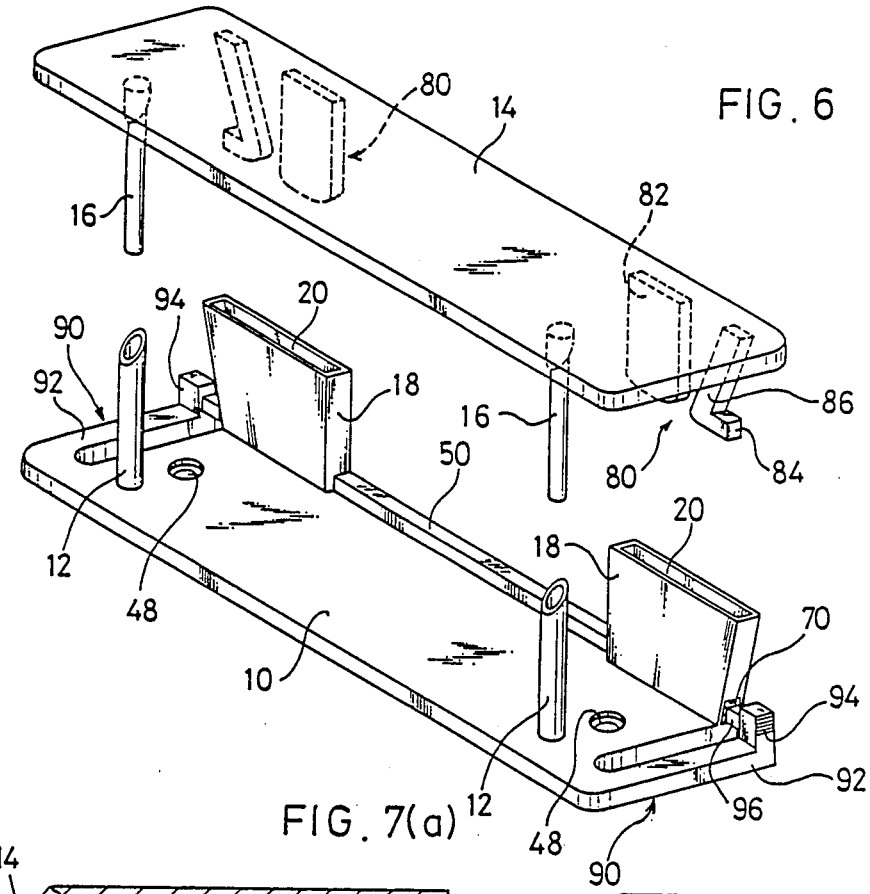
FIG. 6
FIG. 7(a)
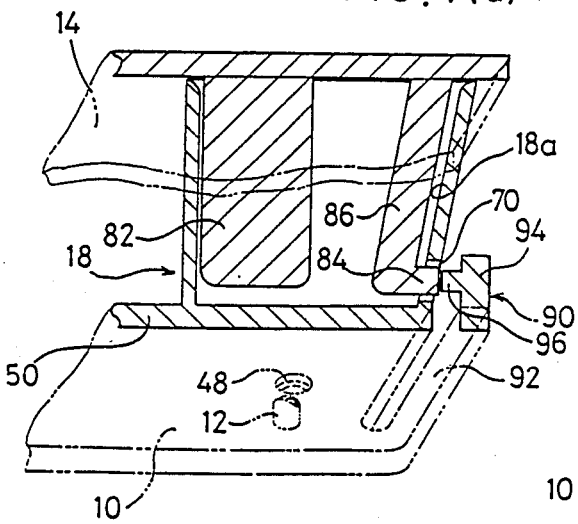
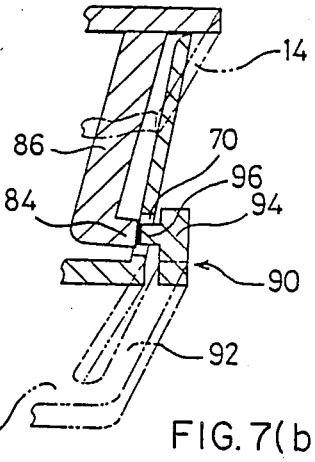
FIG. 7(b)

BINDING DEVICE

FIELD OF THE INVENTION

This invention relates to a binding device for filing papers and the like by being fixed to a filing cover, particularly to a binding device having an improved releaseable mechanism with a cover plate.

BACKGROUND OF THE INVENTION

Hitherto, there have been developed and utilized many types of binding devices for filing papers and the like which comprise a fixture with pipe fittings and a cover plate with coupling rods operable by insertion or removal of the coupling rods into and from the pipe fittings. Further, there have been proposed some available methods for fixing and releasing the cover plate. These methods, however, have structural disadvantages of complicated mechanisms mostly due to their structures which comprises separately a means for fixing the cover plate to the fixture and a means for intensely releasing the cover plate therefrom.

Accordingly, an object of the invention is to provide a binding device comprising in the same arrangement a means for securely fixing the cover plate of the binding device to the fixture thereof and a means for lightly releasing the cover plate from the fixture with a convenient operation and a high productivity.

SUMMARY OF THE INVENTION

In order to overcome the foregoing disadvantages, the invention provides a binding device which comprises an elongated fixture having at least one pipe fitting along one longitudinal edge thereof and a cover plate having along one longitudinal edge thereof at least one coupling rod to be inserted into said pipe fitting, wherein the fixture is provided with upstanding support members along the longitudinal opposite edge at a predetermined distance, each of said upstanding support members being provided with a vertically extended slit and an external recess thereof in communication with the slit, and the fixture is further provided at its opposite cross edges with elastic arm members, each of said elastic arm members at its one end being secured to the fixture and at its opposite free end being confronted with the recess of the support member, while the cover plate is provided in the vicinity of its longitudinal opposite end with insertion members each comprising a vertical guide piece member and a flexible piece member with an outward protrusion and arranged symmetrically to cope with the upstanding support members of the fixture.

The recess may be selectively provided at the upper or lower portion of the support member where the upper recess may receive an upper outward protrusion of the insertion member integrally formed, while the lower recess may receive a lower outward protrusion provided separately from the insertion member. The outward protrusion, when provided with an expanded taper surface or a curved taper surface, may facilitate removal of the cover plate from the fixture. Further, when at least an inner surface of the external side wall of the slit of the support member is converged into the bottom thereof or when a flexible piece member of the insertion member is slightly inwardly slanted, the cover plate may be conveniently removed from the fixture.

The elastic arm member is provided at its free end with an urging projection adapted to disengage the outward protrusion of the insertion member from the recess and the elastic member may be of a separate releasable elastic arm member, a longitudinal elastic arm member arranged to upstand along the support member or of a lateral elastic member arranged along the cross edge of the fixture. The separate elastic arm member, when painted, for example, in different color from the binder may enhance the design value, while the longitudinal and lateral elastic members may be prepared integrally with synthetic resins with improved operation and cost.

On fixing the cover plate of the binder to the fixture after the filing operation finished, an end of the coupling rod of the cover plate is inserted into the pipe fitting of the fixture, while an insertion member of the cover plate is inserted into the support member of the fixture with subsequent depression, so that the flexible piece member of the insertion member slides flexibly down with an inward pressure until an outward projection of the flexible piece member falls into the open recess provided in the support member and stops with a slight outward open in the width of the protrusion. Thus, the cover plate of the binder is firmly fixed to the fixture. On release of the cover plate from the fixture, when the protrusion at the end of the flexible piece member is inwardly pushed lightly with the finger from the outside through the free edge portion or the protrusion of the elastic member, the engagement of the support member with the insertion member is released and simultaneously the cover plate is pushed upwardly under the pressure upon release of the support member.

For better understanding, the invention will now be described hereinbelow in more detail with reference to the accompanying drawings.

BRIEF DESCRIPTION OF THE DRAWINGS

FIGS. 3(*a*), (*b*), (*c*) and (*d*) are enlarged sectional views for illustration of the correlation between the support member, the insertion member and the elastic member of FIG. 1;

FIG. 4 is a disassembled perspective view of another embodiment of the binder according to the invention;

FIGS. 5(*a*) and (*b*) are enlarged sectional views for illustration of the correlation between the support member, the inserting member and the elastic member of FIG. 4;

FIG. 6 is a disassembled perspective view of another embodiment of the binder according to the invention;

FIGS. 7(*a*) and (*b*) are enlarged sectional views for illustration of the correlation between the support member, the insertion member and the elastic member of FIG. 6.

PREFERRED EMBODIMENTS OF THE INVENTION

Figure 1:
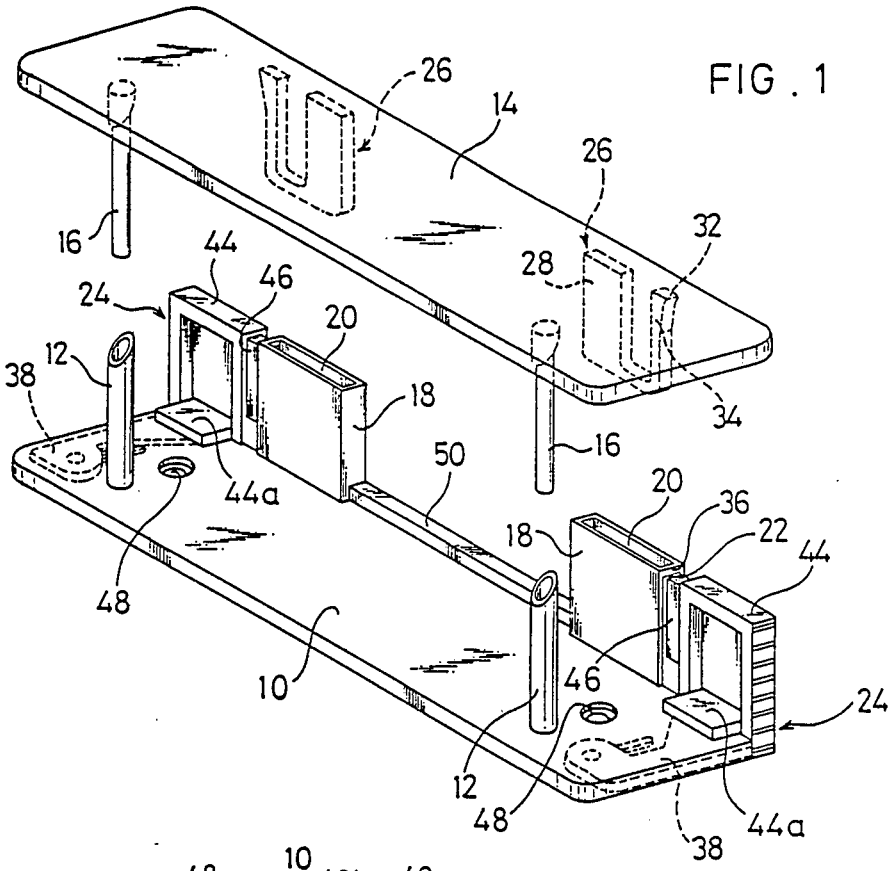
FIG. 1 is a disassembled perspective view of one embodiment of the binding device according to the invention.

An embodiment of FIG. 1 includes a basic structure of the binder which comprises an elongated fixture 10 provided with the pipe fittings 12, 12 along the vicinity of one longitudinal side edge thereof and an elongated cover plate 14 provided along its one longitudinal edge with coupling rods 16, 16 adapted to be inserted into the pipe fittings 12, 12. Further, the fixture 10 along its opposite longitudinal side edge is provided with upstanding support members 18, 18 at a predetermined distance, each of said support members being provided with slits 20, 20 extended perpendicularly to the bottom of the support member and each external walls of the support members 18, 18 are opened with elongated recess 22, 22 in communication with the slits 20, 20. Furthermore, the fixture 10 at its opposite cross edges is provided with elastic arm members 24, 24, which at its one end is secured to the fixture 10, while at its opposite free end is confronted to the recess 22 of the upstanding support members 18. In contrast, the cover plate 14 is provided in the vicinity of its opposite edge with insertion members 26, 26 at a predetermined distance each having a vertical guide piece member 28 and a flexible piece member 34 with a protruded free end so as to confront to the upstanding support members 18, 18 of the fixture 10.

The fixture 10 is further provided with apertures 48, 48 for securing to the inside of the filing cover (not shown). Either the fixture 10 or the cover plate 14 is provided with a reinforcing rim 50 at their longitudinal side edge (in the figure only a reinforcing rim 50 of the fixture 10 is shown).

In the first embodiment according to the invention, the recess 22 of the support member 18 is constructed as an upper recess, the insertion member 26 as an integral insertion member and the elastic member 24 as a separate elastic arm member respectively. Namely, the upper recess 22 is formed in the external wall of the support member 18 into an elongated opening except an upper end 36 having a curved guide surface 36*a* as shown in FIG. 3.

The integral insertion member 26 is formed such that a vertical guide plate 28 is suspended in the vicinity of the longitudinal side edge of the cover plate 14 and from an outer lower portion of the guide plate 28 a rod-like flexible piece member 34 having an upper outward protrusion 32 is upwardly extended in curve. An outer surface of the outward protrusion of the rod-like flexible piece member 34 is formed into an expanded taper surface or a curved taper surface 32*a* as shown in FIG. 3 for smoothly sliding on the guide surface 36*a* at the upper end of the recess.

Figure 2:
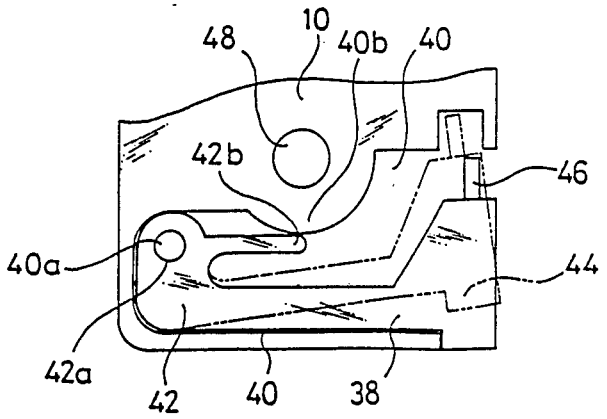
FIG. 2 is an enlarged back view of the fixture of FIG. 1 to which an elastic piece member of the elastic member is fixed.

The separate elastic member 24 comprises a pushing member 44 having a projection 46 and an elastic piece member 38 detachably secured to a recess 40 provided in the rear surface of the fixture 10. The elastic arm piece member 38 at its one end is formed with a shaft support 42 and the shaft support 42, when the supporting shaft 40*a* provided in the recess portion 40 is inserted into the shaft groove 42*a* provided in the center thereof and simultaneously the stopper 42*b* is engaged with the semi-circular protrusion 40*b*, is unmovably fixed within the recess portion 40. The elastic arm piece member 38 at its opposite end is provided with a box-shaped pusher 44 extended along the outside of the support member 18 and on the surface of the pusher 44 confronted to the recess 22 or the free end of the elastic arm member 24 is formed a pushing projection 46. The pusher 44 is urged toward the recess 22, so that the elastic arm piece member 38 is deformed and displaced into the mode as shown in FIG. 2 by the two-dotted lines for protruding the pushing projection 46 into the recess 22. Further, the separate elastic arm member 24 is elastically engaged with the fixture 10 by means of a stopping plate 44*a* arranged in the pusher 44.

A typical application of the binder thus constructed according to the invention will be explained hereinafter with reference to FIGS. 3(*a*), (*b*), (*c*) and (*d*).

In binding operation, papers are bound through the pipe fittings 12 of the fixture 10 before the coupling rods 16 of the cover plate 14 are inserted into the pipe fittings 12 and simultaneously the insertion member 26, 26 are slidably inserted into the slits 20, 20 of the support members 18, 18. Then, as shown in FIG. 3(*a*), when the vertical guide plate 28 of the insertion member 26 comes slidably into contact with one internal surface of the support member 18, the taper surface 32*a* of the outward protrusion 32 of the rod-like flexible piece member 34 is engaged with a guide surface 36*a* of the upper portion 36 of the recess as shown in FIG. 3(*a*). When the insertion member 26 is pushed downwardly in one breath, the flexible piece member 34 with the taper surface 32*a* of the outward protrusion 32 slides on the guide surface 36*a* receiving the strong inward pressure and is flexibly and inwardly moved as shown in FIG. 3(*b*) to stop when the outward protrusion 32 is fallen into the recess 22 as shown in FIG. 3(*c*). Thus, the outward protrusion 32 is engaged with the recess 22 and the cover plate 14 is firmly fixed to the fixture 10.

When the cover plate 14 is released from the fixture 10 in order to remove the filed papers, the pushing portions 44, 44 of the elastic arm members 24, 24 are inwardly urged each other. Then, the pushing portion 44 through the elastic arm piece member 38 is inwardly displaced and the pushing protrusion 46 is urged into the recess 22 to collide with the outward protrusion 32 with slight inward movement for disengagement of the outward protrusion 32 from the recess 22 as shown in FIG. 3(*d*). Thus, the flexible piece member 34, which is inwardly yielded with load of a strong outward restoring force, is upwardly moved with an outward restoring displacement by sliding the tapered surface 32*a* on the guide surface 36*a* to elevate in one breath the cover plate 14 to a position as illustrated in FIG. 3(*a*). Then, the cover plate 14 may be conveniently released from the fixture 10 with light picking.

FIGS. 4, 5(*a*) and (*b*) shown another embodiment of the binding device according to the invention. In this embodiment, the separate elastic arm member of the embodiment shown in FIG. 1 is constructed as an integral elastic arm member. The explanation about the other constructions of the binding device than the elastic arm member has been omitted because of identity with the embodiment as illustrated in FIG. 1.

Namely, an elastic arm piece member 62 of an elastic arm member 60 at its one end is integrally secured to one cross end of the fixture 10 in confronting with the support member 18 and the elastic arm piece member 62 at its opposite end is expanded with a pushing portion 64 and in the surface of the pushing portion 64 confronting to the recess 22 of the support member or a free end portion of the elastic arm member 60 is provided with a pushing protrusion 66.

The pushing protrusion 66, when the cover plate 14 is secured to the fixture 10 so that the outward protrusion 32 of the rod-like flexible piece member 34 is engaged into the recess 22 is located in a position confronting to the outward protrusion 32 as shown in FIG. 5(*a*). However, when the pushing portion 64 is inwardly urged as shown in FIG. 5(*b*), the elastic arm piece member 62 is yielded inwardly, so that the pushing protrusion 66 is urged into the recess 22 to collide with the outward protrusion 32 for slight movement and subsequent disengagement of the outward protrusion 32 from the recess 22. Accordingly, the cover plate 14 may be conveniently and securely released like the embodiment as hereinbefore described. Moreover, the fixing operation of the cover plate 14 may be conveniently carried out like the embodiment as hereinbefore described.

FIGS. 6, 7(*a*) and (*b*) show a further embodiment of the binding device according to the invention. In this embodiment, the recess is opened in the lower portion of the support member, the insertion member is formed into separate members on the cover plate and the separate elastic arm members are integrally provided on the opposite cross ends of the fixture. Further, the whole construction of the binding device except the support member which is preferably formed as hereinafter described is identical with the embodiment as hereinbefore described, for which reason the explanation thereabout has been omitted because of identity.

The support member 18 is formed such that an external wall 18*a* of the slit 20 is somewhat tilted toward the bottom for convergence which may facilitate release of the cover plate 14 from the fixture 10.

A recess 70 is opened in the external wall of the support member 18. A separate insertion member 80 comprises a flat vertical guide plate 82 suspended vertically along the longitudinal side end of the cover plate 14 and a L-shaped flexible piece member 86 having an outward projection 84, which is preferably inclined inwardly. An elastic arm member 90 provides an elastic piece member 92 which at its one end is integrally secured to the cross end of the fixture 10 and at its opposite free end 92 is provided with an upstanding pushing portion 94 with a pushing projection 96 confronting to the recess 70 of the support member.

The pushing projection 96, when the cover plate 14 is fixed to the fixture 10 for engagement of the outward projection 84 of the L-shaped flexible piece member 86 with the recess 70 is located in a position opposite to the outward projection 84 as shown in FIG. 7(*a*). When the pushing portion 94 is inwardly urged as shown in FIG. 7(*b*), the elastic arm piece member 92 is yielded inwardly for displacement, so that the pushing projection 96 is guided into the recess 70 to collide with the outward projection 84 for slight movement and subsequente engagement of the outward projection 84 from the recess 70. In this status, the L-shaped flexible piece member 80 is yielded inwardly with deformation under the load of the strong outward restoration and the outward projection 84 is slidably elevated along the tilted side wall of the slit 22 so that the L-shaped flexible piece member 80 or the cover plate 14 is automatically urged upwardly from the fixture 10 in one breath like the embodiment as hereinbefore described. A fixing operation of the cover plate 14 may be conveniently carried out like the embodiment as hereinbefore described.

When the elastic arm member is formed into a separate elastic arm member 24 like the embodiment as shown in FIG. 1, for example, the colour of the elastic arm member different from the binding device body could promote a commercial design value of the product. While the integral elastic arm members 60 and 90 of the embodiments as shown in FIGS. 4 and 6 may be formed integrally with the binding device including the fixture 10 and the cover plate 14 with the convenient manufacturing process at an advantageous cost. Furthermore, the coupling rod 16 of the cover plate 14 may be made of metals to perform smooth insertion and release into and from the pipe fitting 12 of the fixture 10.

Figure 8:
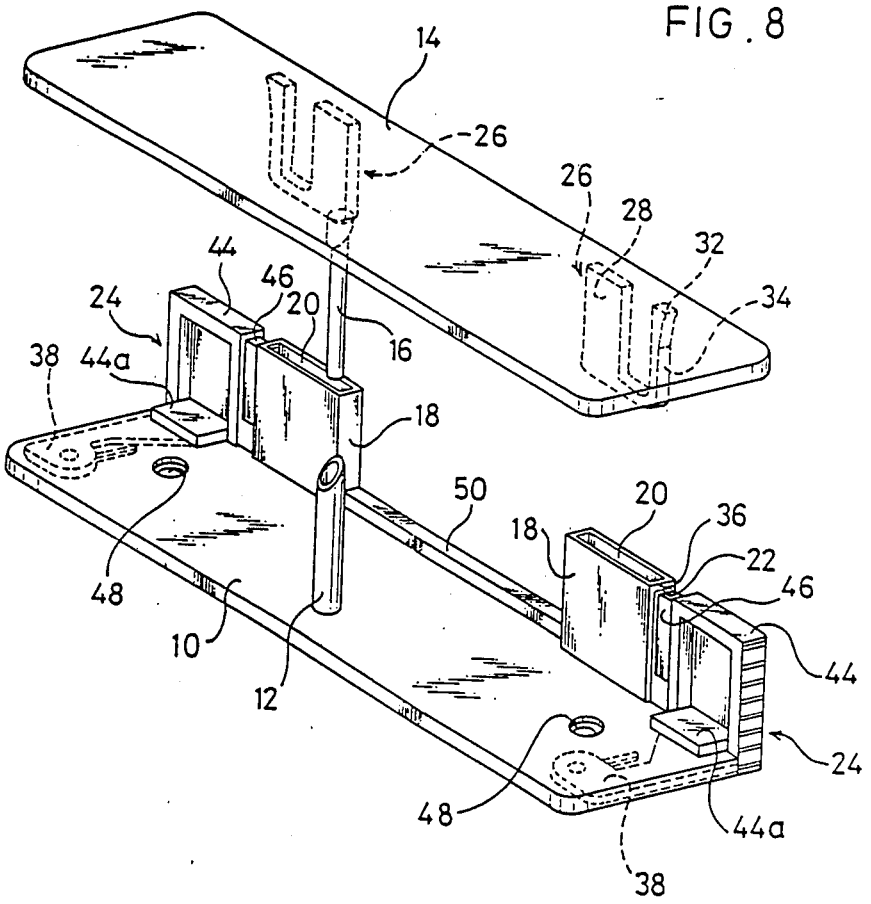
FIG. 8 is a disassembled perspective view of a modified embodiment of the binder according to the invention.

FIG. 8 shows a further modified embodiment of the binding device according to the invention. Namely, in this embodiment a single pipe fitting 12 is provided in the fixture 10 while a single coupling rod 16 adapted to be inserted into the pipe fitting 12 is arranged in the cover plate 14. The other constructions are identical with those of the embodiment as illustrated in FIG. 1. The binding device thus constructed may be advantageously used as the binding means for conveniently filing the chits and the like. The positions of the pipe fitting 12 of the fixture 10 and the coupling rod 16 of the cover plate 14 may be optionally determined as desired according to the purpose for use.

In the binding device according to the invention as hereinbefore fully described, each component of the device may be integrally formed with the fixture and the cover plate, which ensures a simple manufacturing process with a sufficient reduction of the manufacturing cost and also a smooth operation of the device in use.

Although the invention has been described hereinbefore with respect to the preferred embodiments thereof, it will be appreciated that many variations and modifications may be made without departing from the true spirit and scope of the invention. For example, in the embodiments as illustrated in FIGS. 4 and 6, the integrally formed elastic arm members may be modified into the separate or independent elastic arm members. In addition, the shape or the like of each component may be conveniently changed or modified and further the numbers of the pipe fittings and rods may be selected to three or more.

What is claimed is:

1. A binding device which comprises an elongated fixture having at least one pipe fitting in the vicinity of one longitudinal side end thereof and a cover plate having along one longitudinal edge thereof at least one coupling rod adapted to be inserted into said pipe fitting, wherein the fixture is provided with support members along its longitudinal opposite side end at a predetermined distance, each of said support members being provided with a vertically extended slit and an external recess in communication with the slit and the fixture is further provided at its opposite cross ends with elastic arm members, each of said elastic arm members at its one end being secured to the fixture and at its opposite free end being confronted with the recess of the support member, while the cover plate is provided in the vicinity of its longitudinal opposite end with insertion members each comprising a vertical guide piece member and a flexible piece member with an outward protrusion and arranged symmetrically to cope with the support members of the fixture.

2. A binding device according to claim 1, wherein the recess is provided in an upper part of the support member and the flexible piece member of the insertion member adapted to be inserted into the slit of said support member is extended in bending upwardly from the external lower end portion of the vertical guide plate providing an outward protrusion at its upper end so as to engage with the recess.

3. A binding device according to claim 2, wherein the flexible piece member is formed to taper or expand toward the outward protrusion of the upper end thereof.

4. A binding device according to claim 1, wherein the recess is opened in the lower portion of the support member and a flexible piece member of the insertion member adapted to be inserted from the vertical guide plate into the slit of the support member is extended in separate at a predetermined distance apart to from a L-shape with an outward protrusion to engage with the recess.

5. A binding device according to claim 4, wherein at least one side wall of the slit of the support member is tapered for convergence toward the bottom thereof.

6. A binding device according to claim 4, wherein the L-shaped flexible piece member of the insertion member of the cover plate is somewhat slanted inwardly.

7. A binding device according to claim 1, wherein the elastic arm member comprises a pressure portion with a pushing protrusion confronting to the recess of the support member and an elastic arm piece member flexible and displaceable in the same plane as the fixture, said elastic arm piece member being secured at its one end to the fixture.

8. A binding device according to claim 7, wherein the elastic arm member is formed integrally with the fixture.

9. A binding device according to claim 7, wherein the elastic arm member comprises an elastic arm piece member which is received in a cavity provided in the rear side of the fixture.

10. A binding device according to claim 1 wherein the elastic arm member comprises an elastic arm piece member upstanding vertically from the cross end portion of the fixture and a pushing member provided at the end portion thereof.

* * * * *